US012252986B2

(12) United States Patent
Ma et al.

(10) Patent No.: US 12,252,986 B2
(45) Date of Patent: Mar. 18, 2025

(54) STEERABLE DRILLING DEVICE

(71) Applicants: China Petroleum & Chemical Corporation, Beijing (CN); Sinopec Petroleum Engineering Technology Service Co., Ltd, Beijing (CN); Sinopec Shengli Petroleum Engineering Co., Ltd, Shandong (CN); Sinopec Matrix Corporation, Shandong (CN); Geosteering & Logging Research Institute, Sinopec Matrix Corporation, Shandong (CN)

(72) Inventors: Qingming Ma, Shandong (CN); Jieran Zhu, Shandong (CN); Ningning Yang, Shandong (CN); Guangquan Li, Shandong (CN); Yufeng Li, Shandong (CN); Nan Lin, Shandong (CN); Haiquan Tang, Shandong (CN); Haiyang Du, Shandong (CN); Chao Lu, Shandong (CN)

(73) Assignees: CHINA PETROLEUM & CHEMICAL CORPORATION, Beijing (CN); SINOPEC PETROLEUM ENGINEERING TECHNOLOGY SERVICE CO., LTD, Beijing (CN); SINOPEC SHENGLI PETROLEUM ENGINEERING CO., LTD, Shandong (CN); SINOPEC MATRIX CORPORATION, Shandong (CN); GEOSTEERING & LOGGING RESEARCH INSTITUTE, SINOPEC MATRIX CORPORATION, Shandong (CN)

( * ) Notice: Subject to any disclaimer, the term of this patent is extended or adjusted under 35 U.S.C. 154(b) by 21 days.

(21) Appl. No.: 18/248,907

(22) PCT Filed: Oct. 15, 2021

(86) PCT No.: PCT/CN2021/123962
§ 371 (c)(1),
(2) Date: Apr. 13, 2023

(87) PCT Pub. No.: WO2022/078476
PCT Pub. Date: Apr. 21, 2022

(65) Prior Publication Data

US 2023/0383605 A1 Nov. 30, 2023

(30) Foreign Application Priority Data

Oct. 16, 2020 (CN) ..... 202011107024.9

(51) Int. Cl.
*E21B 17/05* (2006.01)
*E21B 7/04* (2006.01)
(Continued)

(52) U.S. Cl.
CPC ..... *E21B 7/067* (2013.01); *E21B 17/05* (2013.01); *E21B 41/0085* (2013.01); *E21B 47/022* (2013.01)

(58) Field of Classification Search
CPC ..... E21B 7/06; E21B 17/05; E21B 7/067
See application file for complete search history.

(56) References Cited

U.S. PATENT DOCUMENTS 7,866,415 B2 * 1/2011 Peters ..... E21B 7/06 175/73
9,371,696 B2 * 6/2016 Oppelaar ..... E21B 7/067
(Continued)

FOREIGN PATENT DOCUMENTS

CN 101871320 A 10/2010
CN 102606073 A 7/2012
(Continued)

OTHER PUBLICATIONS

International Search Report for PCT/CN2021/123962, mailed Jan. 19, 2022.

*Primary Examiner* — Tara Schimpf
*Assistant Examiner* — Ursula Lee Norris
(74) *Attorney, Agent, or Firm* — NKL Law; Allen Xue

(57) ABSTRACT

A steerable drilling device has an outer tube extending along a longitudinal axis; a drill bit joint inserted into said outer tube, a lower end of said drill bit joint extending out of a lower end of said outer tube for connection to a drill bit; a joint drive mechanism, provided in said outer tube and configured to drive said drill bit joint to swing relative to the longitudinal axis; and a lower connection mechanism. The lower connection mechanism has a connection body connected to said joint drive mechanism in such a manner that said joint drive mechanism is non-rotatable with respect to said connection body, a first centralizer arranged between said connection body and said outer tube, a circuit system arranged in said connection body and configured to provide an electrical signal to said joint driving mechanism, and an attitude sensor arranged in said connection body.

9 Claims, 3 Drawing Sheets

(51) Int. Cl.

| | |
|---|---|
| ***E21B 7/06*** | (2006.01) |
| ***E21B 41/00*** | (2006.01) |
| ***E21B 47/022*** | (2012.01) |

(56) References Cited

U.S. PATENT DOCUMENTS

| | | | | |
|---|---|---|---|---|
| 10,443,307 | B2 * | 10/2019 | Du | E21B 44/00 |
| 2012/0043133 | A1 | 2/2012 | Millet | |
| 2015/0167453 | A1 | 6/2015 | Forstner et al. | |
| 2017/0314332 | A1 * | 11/2017 | Kirkhope | E21B 44/00 |
| 2018/0016845 | A1 * | 1/2018 | Peters | E21B 44/00 |
| 2019/0277091 | A1 | 9/2019 | Jones et al. | |
| 2020/0240212 | A1 | 7/2020 | Von Gynz-Rekowski et al. | |

FOREIGN PATENT DOCUMENTS

| | | | |
|---|---|---|---|
| CN | 203614036 | U | 5/2014 |
| CN | 104215438 | A | 12/2014 |
| CN | 104499940 | A | 4/2015 |
| CN | 204238856 | U | 4/2015 |
| CN | 105051316 | A | 11/2015 |
| CN | 204827226 | U | 12/2015 |
| CN | 107165935 | A | 9/2017 |
| CN | 107939288 | A | 4/2018 |
| CN | 108035677 | A | 5/2018 |
| CN | 108266130 | A | 7/2018 |
| CN | 108505940 | A | 9/2018 |
| CN | 108612479 | A | 10/2018 |
| CN | 111379521 | A | 7/2020 |
| CN | 114370229 | A | 4/2022 |
| CN | 114382407 | A | 4/2022 |
| CN | 114382408 | A | 4/2022 |
| WO | 2014107232 | A2 | 7/2014 |

* cited by examiner

STEERABLE DRILLING DEVICE

CROSS-REFERENCE OF RELATED APPLICATION

The present application is a national entry of International Application No. PCT/CN2021/123962 filed on Oct. 15, 2021, which claims the benefit of priority to the Chinese patent application No. 202011107024.9, entitled "Steerable drilling device" and filed on Oct. 16, 2020, the entire content of which is incorporated herein by reference.

TECHNICAL FIELD

The present invention relates to the field of oil drilling engineering, and in particular to a steerable drilling device.

TECHNICAL BACKGROUND

During the drilling process in horizontal wells or inclined wells, it is usually necessary to change the drilling direction of the drill bit by means of a steerable drilling device, in order to control the drilling trajectory in real time.

Existing steerable drilling devices mainly include two types, including a pushing-type steerable device and a directing-type steerable device.

A common pushing-type steerable device is provided with a pushing piston that can extend towards the well wall at a side of the drilling column. The position and direction of the drill bit can be changed by a force exerted by the piston on the well wall. The pushing-type steerable device requires that the drilling column per se cannot be rotatable, so that there exists a relatively high risk in downhole operation. In addition, for such a pushing-type steerable device, the stroke of the piston is affected by many factors, but the operator can only control the stroke through the force used for driving the piston. Therefore, the deflecting effect generated by the pushing-type steerable device is highly dependent on the formation condition. In addition, when it is necessary to keep drilling in one direction, it can hardly ensure that the drilling column is completely centered. At present, there also exist solutions wherein the drilling column is allowed to rotate by frequent extension and retraction of the pushing piston. However, this would result in frequent extension and retraction of the piston in the steerable device, which is a challenge for the sealing performance and service life of the piston.

The directing-type steerable device has a housing and a central shaft that are bendable. The position and direction of the drill bit can be changed by adjustment of the direction and degree of bending of the housing and the central shaft. In addition, the central shaft of the device should be connected to the upstream and downstream drill tools, so that it is axially pressurized. Through increasing the axis pressure of the central shaft, the central shaft and its external housing are bent, so as to change the direction and degree of bending of the drilling column. However, because the housing and the central shaft have to be bent repeatedly, fatigue damage is prone to occur, which affects the safety of the drilling operation.

In addition, as mentioned above, there also exist solutions wherein the drill column is allowed to rotate. In order to ensure that the measurement results of the sensors are accurate, the structural part where the sensors are located is usually unable to rotate, or is substantially non-rotatable. However, it generally demands an electrical connection between the rotating part of the drilling column and the non-rotatable structural part where the sensors are located. In this case, the electrical connection should be achieved through electrical contact connectors that are rotatable with each other. However, this electrical connection is poor in stability and has difficulty in adapting to the underground environment, and thus is prone to failure.

SUMMARY OF THE INVENTION

In view of the foregoing, the present invention proposes a steerable drilling device, with which at least one of the above problems can be eliminated or alleviated.

According to the present invention, a steerable drilling device is provided, comprising: an outer tube extending along a longitudinal axis; a drill bit joint inserted into said outer tube, a lower end of said drill bit joint extending out of a lower end of said outer tube for connection to a drill bit, said drill bit joint being configured to rotate with said outer tube; a joint drive mechanism, provided in said outer tube and configured to drive said drill bit joint to swing relative to the longitudinal axis; and a lower connection mechanism. The lower connection mechanism comprises: a connection body, which is connected to said joint drive mechanism in such a manner that said joint drive mechanism is non-rotatable with respect to said connection body; a first centralizer, arranged between said connection body and said outer tube, and rotatably connected to said connection body; a circuit system, arranged in said connection body and configured to provide an electrical signal to said joint driving mechanism for driving said drill bit joint to swing; and an attitude sensor, arranged in said connection body and configured to measure deflection and orientation of a well and transmit measurement data to said circuit system. Said circuit system is capable of providing the electrical signal to said joint drive mechanism through a wire extending in the connection body and the joint drive mechanism.

With the above-mentioned device, the drill bit joint can be driven to swing by the joint drive mechanism, and therefore the drill bit can be swung accordingly. In this case, it does not require the outer tube, the joint drive mechanism and the drill bit joint to be bent. Especially, it is not necessary for the joint drive mechanism to be pressurized between the upstream and downstream drill columns, thus effectively ensuring the structural stability and integrity of these components during long-term operation, and further contributing to the structural protection of the entire steerable drilling device. In addition, the first centralizer allows the lower connection mechanism and the joint drive mechanism not to rotate along with the outer tube and the drill bit joint. In this manner, it ensures accurate results detected by the attitude sensor in the lower connection mechanism. Moreover, the connection body is fixed relative to the joint drive mechanism, so that the circuit system in the connection body and the joint drive mechanism can be connected electrically through the wire directly. This enables the electrical connection between the circuit system and the joint drive mechanism to be more stable, which is beneficial to ensuring smooth downhole inspection and the swing motion of the drilling bit joint.

In one embodiment, said joint driving mechanism comprises at least three drive assemblies, which are arranged circumferentially spaced apart from each other around an upper end of said drill bit joint. Each drive assembly comprises a push rod extending in a radial direction, said push rod being configured to move in the radial direction to engage with the upper end of said drill bit joint, so as to push said drill bit joint to swing when the push rod moves in the radial direction.

In one embodiment, the upper end of said drill bit joint is formed with a second spherical engagement protrusion, and an inner end of said push rod is formed with a second spherical engagement groove, which is configured to receive said second spherical engagement protrusion.

In one embodiment, each drive assembly further comprises: a motor electrically connected to said circuit system via the wire for receiving the electrical signal from said circuit system; a reducer, provided downstream of said motor and coupled thereto; an output shaft, extending from a lower end of said reducer in parallel to the longitudinal axis; a driving gear having an axis parallel to the longitudinal axis, said driving gear being configured as a bevel gear and fixedly connected to a lower end of said output shaft, and being rotatable under drive of said motor; and a driven gear having an axis extending in the radial direction, said driven gear being configured as a bevel gear in engagement with said driving gear and driven in rotation by the driving gear, wherein said driven gear is provided with a central hole extending along its axis and having a first threaded portion formed therein. A second threaded portion is formed on an outer end of said push rod, which is configured to be inserted into the central hole so that said first threaded portion and said second threaded portion come into engagement with each other. Said driven gear is rotatable relative to said push rod, so as to move said push rod in the radial direction through said first threaded portion and said second threaded portion in engagement with each other.

In one embodiment, each driving assembly further comprises a driving housing accommodating the motor, the reducer, the output shaft and the driving gear, wherein said driving housing is fixedly connected to said connection body, and said wire extends within said connection body and said driving housing.

In one embodiment, the driven gear and the push rod extend at least partially out of said drive housing from an opening in said drive housing. Each drive assembly further comprises a retractable sleeve, which is arranged around said driven gear and said push rod extending at least partially out of said drive housing from the opening of said drive housing, one end of said retractable sleeve being sealingly connected to the opening of said drive housing and the other end thereof being sealingly connected to the inner end of said push rod. At least a portion of said retractable sleeve and said drive housing is filled with hydraulic oil.

In one embodiment, said retractable sleeve is a bellows.

In one embodiment, said steerable drilling device further comprises a central shaft disposed centrally in said outer tube along the longitudinal axis, said central shaft being rotatably supported on said outer tube through an upper connection mechanism and said lower connection mechanism, and fixedly connected to the connection body of said lower connection mechanism. A power generation mechanism is mounted on said central shaft, and comprises: a generator assembly connected to said circuit system to supply power to said circuit system; an upper turbine, arranged above said generator assembly and configured to rotate freely in a first direction of rotation relative to said central shaft; a lower turbine, arranged below said generator assembly and configured to rotate freely in a second direction of rotation relative to said central shaft; and an electromagnetic stabilization assembly arranged below said lower turbine. Said first direction of rotation and said second direction of rotation are opposite to each other and both perpendicular to the longitudinal axis.

In one embodiment, said upper connection mechanism comprises: a first cylinder, arranged in said outer tube and attached thereto through a second centralizer arranged between the first cylinder and the outer tube; and a second cylinder, arranged in said first cylinder and rotatably fit with said first cylinder with a bearing assembly, said second cylinder being connected to said central shaft.

In one embodiment, an upper sensing element is provided within said first cylinder, above said second cylinder and spaced apart therefrom, and a lower sensing element is provided within said second cylinder, Compared with the prior arts, the present application mainly presents the following advantages. It does not require various components in the device to be bent. Especially, it is not necessary for the joint drive mechanism to be pressurized between the upstream and downstream drill columns, thus effectively ensuring the structural stability and integrity of these components during long-term operation, and further contributing to the structural protection of the entire steerable drilling device. In addition, the outer tube can freely rotate without affecting the operation state of each of the components arranged therein, nor affecting the orientation of the drill bit. In this manner, the downhole backing pressure can be reduced, and the risk of downhole operation can be effectively lowered. Moreover, through rotating the upper and lower turbines mounted on the center shaft in opposite directions (i.e., in the first and second directions of rotation respectively) to generate opposite torques, and also in combination with the electromagnetic stabilization assembly, the center shaft can always remain stationary or rotate slowly relative to the formation in the operation of the steerable drilling device. Further, with the engagement of multiple drive assemblies with the drill bit joint, the direction and angle of the swing of the drill bit joint, and thus those of the drill bit, can be directly controlled. This enables the steerable drilling device of the present invention to effectively keep the drill bit in an accurate drilling orientation state. It also allows the drill bit to be fully centered when a fixed deflection should be maintained. Finally, the electrical connections between the motor, the circuit system, the power generation mechanism and the attitude sensor with each other can all be achieved stably by wires.

BRIEF DESCRIPTION OF THE DRAWINGS

The present invention will be described below with reference to the accompanying drawings.

In the accompanying drawings, the same reference numerals are used to indicate the same components. In the present application, all accompanying drawings are schematic ones, used to illustrate the principle of the present invention merely, and are not necessarily drawn to actual scale.

DETAILED DESCRIPTION OF EMBODIMENTS

The present invention will be described below with reference to the accompanying drawings.

Figure 1:
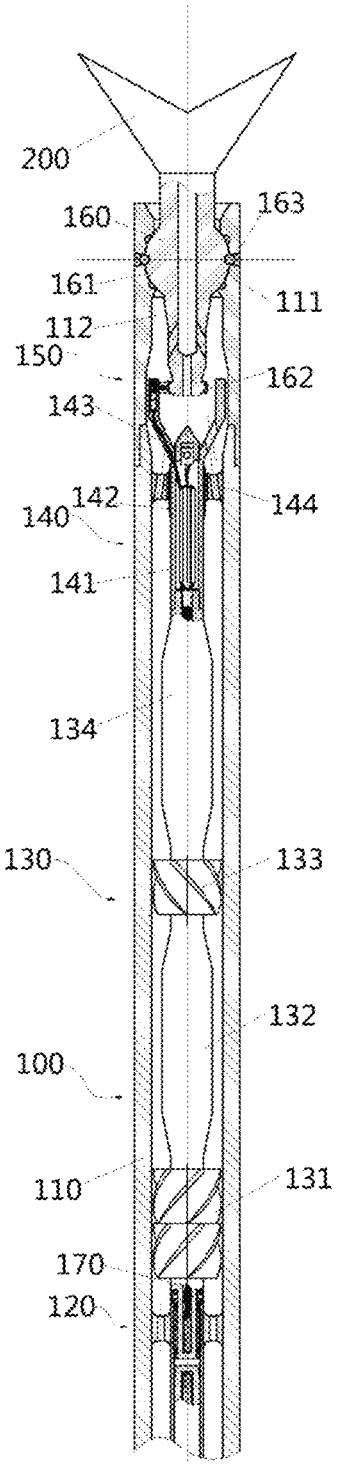
FIG. 1 schematically shows the structure of a steerable drilling device according to an embodiment of the present invention.

As shown in FIG. 1, a steerable drilling device 100 includes an outer tube 110, and a central shaft 170 arranged in the outer tube 110. Both the outer tube 110 and the central shaft 170 are provided along a longitudinal axis, and the central shaft 170 is centered with respect to the outer tube 110.

An upper end of the central shaft is rotatably supported on an inner wall of the outer tube 110 through an upper connection mechanism 120, and a lower end thereof is rotatably supported on the inner wall of the outer tube 110 through a lower connection mechanism 140.

Figure 2:
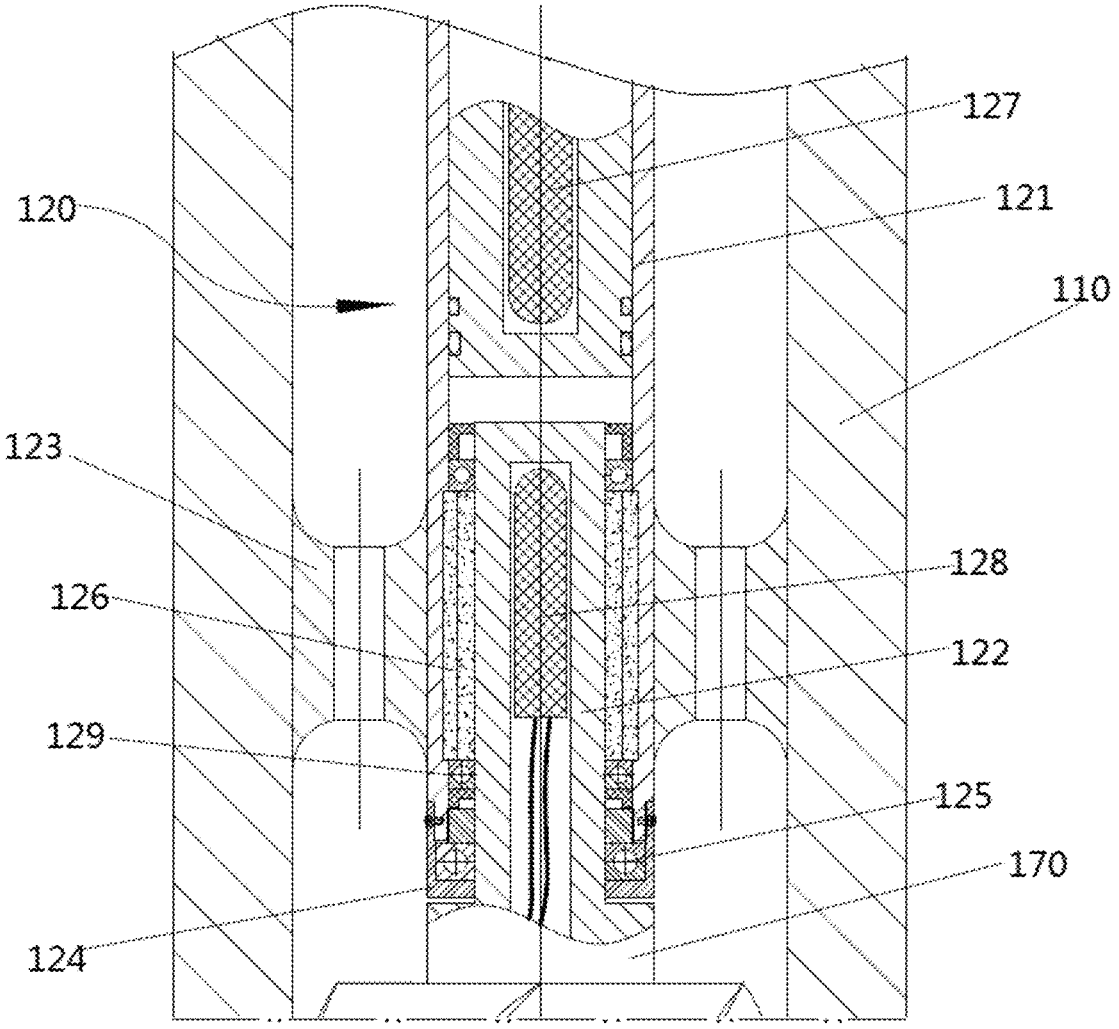
FIG. 2 schematically shows the structure of a part of an upper connection mechanism in the steerable drilling device of FIG. 1.

FIG. 2 schematically shows the specific structure of the upper connection mechanism 120 in an embodiment. The upper connection mechanism 120 includes a first cylinder 121, which is arranged within the outer tube 110 and extends along the longitudinal axis. The first cylinder 121 is fixedly attached to the inner wall of the outer tube 110 through a second centralizer 123 provided between the first cylinder 121 and the outer tube 110. A second cylinder 122 is arranged in the first cylinder 121, and has a lower end fixedly connected to the central shaft 170. The second cylinder 122 extends in the longitudinal direction, and is rotatable about the longitudinal axis with respect to the first cylinder 121. As shown in FIG. 2, a bearing support 124 is fixedly attached to a lower end of the first cylinder 121, and has an extension that extends radially inwardly, on which a lower thrust bearing 125, an upper thrust bearing 129, and a sliding bearing 126 are arranged around the second cylinder 122. With the lower thrust bearing 125, the upper thrust bearing 129 and the sliding bearing 126, the second cylinder 122 can be held within and rotatable with respect to the first cylinder 121.

In the first cylinder 121, an upper sensing element 127 is provided above the second cylinder 122 and spaced apart therefrom. A lower sensing element 128 is provided in the second cylinder 122. An electromagnetic connection can be generated between the upper sensing element 127 and the lower sensing element 128.

As shown in FIG. 1, the lower connection mechanism 140 includes a cylindrical connection body 141, which has an upper end fixedly connected to a lower end of the central shaft 170. The connection body 141 extends along the longitudinal axis, and is supported on the outer tube 110 by a first centralizer 144 provided between the connection body 141 and the outer tube 110, in order to keep the connection body 141 centered with respect to the outer tube 110. The connection body 141 is rotatably connected to the first centralizer 144 through a bearing assembly. As a result, the connection body 141 can be held in and rotatable relative to the outer tube 110. The connection body 141 is hollow, and accommodates a circuit system 142 and an attitude sensor 143 therein. The circuit system 142 may be configured as a circuit board, and the attitude sensor 143 is configured to measure the deflection and orientation of the well. Instructions from the ground may be transmitted to the circuit system 142 via the upper sensing element 127 and the lower sensing element 128. The circuit system 142 can command the attitude sensor 143 to detect the current deflection and orientation of the steerable drilling device 100. The data measured by the attitude sensor 143 may then be transmitted through the circuit system 142 to the lower sensing element 128, and further to the ground through the lower sensing element 128 and the upper sensing element 127.

In the preferred embodiment shown in FIG. 1, the connection body 141 is provided with a recess at its bottom for receiving the attitude sensor 143, so that the attitude sensor 143 can be stably fixed in the recess, which is beneficial to the accuracy of the measurement. It should be understood, however, that the attitude sensor 143 may be provided at any suitable position in the connection body 141 according to practical needs.

As shown in FIG. 1, a power generation mechanism 130 is mounted on the central shaft 170. The power generation mechanism 130 includes an upper turbine 131, a generator assembly 132, a lower turbine 133, and an electromagnetic stabilization assembly 134, all of which are provided in sequence from top to bottom. The upper turbine 131 and the lower turbine 133 are both free to rotate with respect to the central shaft 170. Therefore, as fluid flows through the upper turbine 131 and the lower turbine 133, they may rotate under the action of the fluid. The generator assembly can convert the rotation of the upper turbine 131 and lower turbine 133 into electrical energy.

In the preferred embodiment as shown in FIG. 1, the upper turbine 131 and the lower turbine 133 rotate in opposite directions. In other words, the upper turbine 131 rotates in a first direction of rotation while the lower turbine 133 rotates in an opposite, second direction of rotation. Both the first direction of rotation and the second direction of rotation are perpendicular to the longitudinal axis.

The electromagnetic stabilization assembly 134 may be, for example, an existing electromagnetic brake. By means of the electromagnetic stabilization assembly 134, the upper turbine 131 and the lower turbine 133 as described above, the central shaft 170 can be kept stationary with respect to the formation, or in a very slowly rotating state at a speed much less than the rotational speed of the outer tube 110.

As shown in FIG. 1, a joint drive mechanism 150 and a drill bit joint 160 are further provided in the outer tube 110, located downstream of the lower connection mechanism 140.

The drill bit joint 160 has a lower end, which extends from a lower end of the outer tube 110 and configured to be fixedly attached to a drill bit 200. A first spherical engagement protrusion 161 is formed in a middle of the drill bit joint 160, and correspondingly, a first spherical engagement groove 111 is formed in the inner wall of the outer tube 110 at the lower end thereof. The first spherical engagement groove 111 is configured to receive the first spherical engagement protrusion 161, so as to allow the drill bit joint 160 to swing freely with respect to the outer tube 110.

In addition, in the embodiment as shown in FIG. 1, a ball suspension 163 is provided between the first spherical engagement groove 111 and the first spherical engagement protrusion 161. With the ball suspension 163, the rotational torque of the outer tube 110 can be transmitted to the drill bit joint 160, in order to drive the drill bit joint 160 and the drill bit 200 in rotation together.

As also shown in FIG. 1, an upper end of the drill bit joint 160 is in a fluid channel 112 which extends throughout the outer tube 110 for the fluid in the well to pass through. The fluid in the well can flow through this fluid channel into the drill bit joint 160, and thereby flow to the drill bit 200.

The joint drive mechanism 150 includes a plurality, at least three, of drive assemblies. These drive assemblies are arranged circumferentially spaced apart from each other around the upper end of the drill bit joint 160. An embodiment of one drive assembly is shown in detail in FIG. 3.

Figure 3:
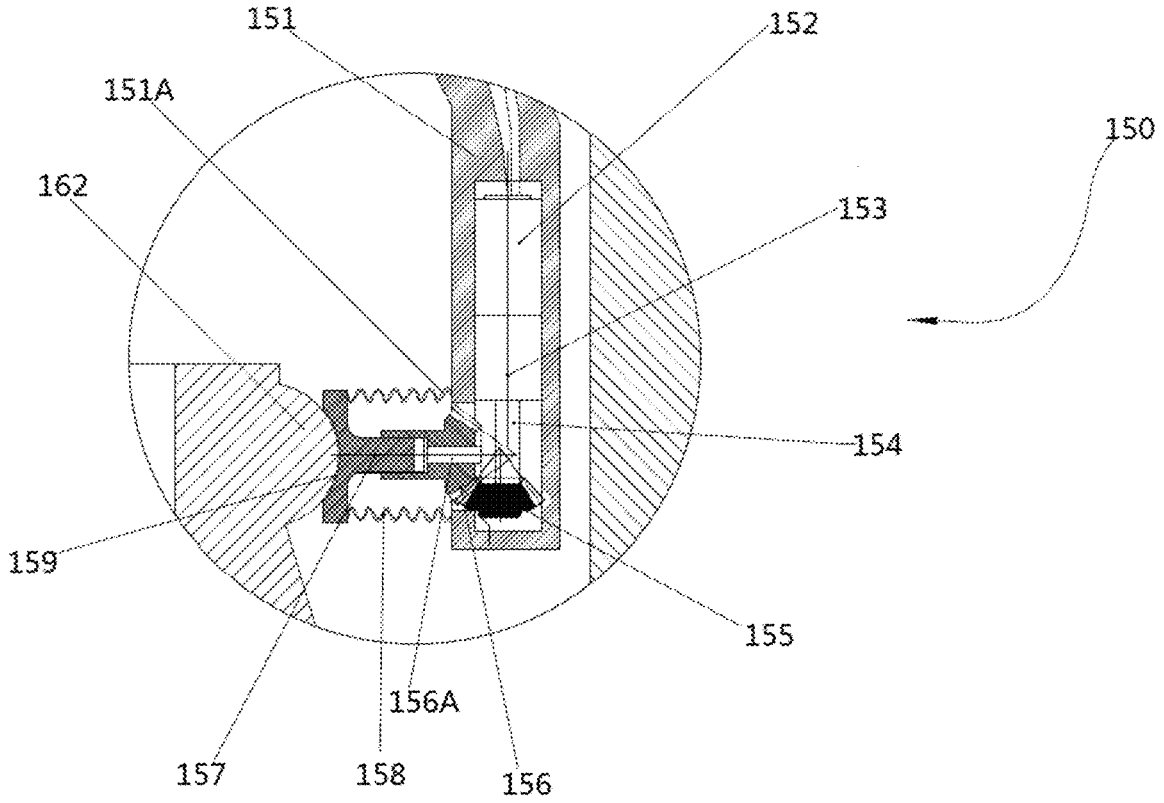
FIG. 3 schematically shows the structure of a part of one of driving assemblies of a joint drive mechanism in the steerable drilling device of FIG. 1.

As shown in FIG. 3, the drive assembly comprises a drive housing 151 extending parallel to the longitudinal axis, which can be connected to the connection body 141 of the lower connection mechanism 140 located above through a connecting bar extending obliquely. In the drive housing 151, a motor 152, a reducer 153, an output shaft 154 and a driving gear 155 are arranged, which are connected in sequence from top to bottom. The driving gear 155 has an axis parallel to the longitudinal axis. The motor 152 can receive electrical energy from the generator assembly 132 through the circuit system 142, and drive the driving gear 155 to rotate about its own axis. The drive assembly further includes a driven gear 156 in engagement with the driving gear 155, such that the driven gear 156 can rotate as the driving gear 155 rotates. The driven gear 156 has an axis extending in a radial direction perpendicular to the longitudinal axis. Both the driven gear 156 and the driving gear 155 may be formed as bevel gears.

Also as shown in FIG. 3, the drive assembly further includes a push rod 157 extending in the radial direction, which has an inner end facing the upper end of the drill bit joint 160. Preferably, the inner end of the push rod 157 is formed with a second spherical engagement groove 159, for receiving a second spherical engagement protrusion 162 formed on an upper side of the drill bit joint 160 to form a stable engagement with the drill bit joint 160. An outer end of the push rod 157 is inserted into a central hole 156A formed at a center of the driven gear 156, which extends along the axis of the driven gear 156, i.e., along the radial direction. The central hole 156A is provided with a first threaded portion therein. Correspondingly, a second threaded portion is formed on the outer end of the push rod 157. When the outer end of the push rod 157 is inserted into the central hole 156A, the first threaded portion and the second threaded portion come into engagement with each other. When the motor 151 drives the driving gear 155, and therefore the driven gear 156, to rotate, the push rod 157 is pressed against the drill bit joint 160 and thus does not rotate along with the driven gear 156. As a result of this relative rotation, the push rod 157 is able to move in the radial direction under the action of the first and second threaded portions which are in engagement with each other, and thereby push the upper end of the drill bit joint 160 so that the drill bit joint 160 can swing.

It should be understood that as the push rod 157 of a drive assembly generates a combined force to push the upper end of the drill bit joint 160 in one direction, the push rod of another drive assembly will avoid the upper end of the drill bit joint 160 accordingly. In this procedure, it can be ensured that the push rods in all the drive assemblies are always pressed against the upper end of the drill bit joint 160. As a result, the swing motion of the drill bit joint 160 can be driven by vector synthesis of multiple drive assemblies. This drive allows a direct control on the direction and angle of the swing motion of the drill bit joint 160, so that the drill bit joint 160 and the drill bit connected thereto can be oriented to the desired state accurately.

It should be understood that during drilling, the drill bit joint 160 is driven by the outer tube 110 to rotate about its own axis continuously. In the event that the drill bit joint 160 swings at an angle relative to the outer tube 110 (i.e., not in a same axis), in order to ensure that the drill bit joint 160 and the bit 200 are accurately oriented to a fixed drilling direction, the plurality of drive assemblies should move periodically, thus pushing or avoiding the upper end of the drill bit joint 160 in real time.

Also as shown in FIG. 3, the push rod 157 and the driven gear 156 extend at least partially out of the drive housing 151 in the radial direction from an opening 151A of the drive housing 151. A retractable sleeve 158, such as a bellows, is arranged around the outer side of the driven gear 156 and the push rod 157 that extend at least partially out of the drive housing 151 from the opening 151A of the drive housing 151. The retractable sleeve 158 has one end sealingly connected to the opening 151A of the drive housing 151, and another end sealingly connected to an inner end edge of the push rod 157. The retractable sleeve 158 and the drive housing 151 are filled therein with hydraulic oil. This ensures that, after the steerable drilling device 100 is lowered into the well, the pressure inside of the retractable sleeve 158 is balanced with that outside of the retractable sleeve 158, thus guaranteeing smooth operation of the drive assembly. It should be understood that the hydraulic oil in the drive housing 151 surrounds the driving gear 155 and the output shaft 154 only, but not contacts the motor 152 and other electrically connected structures thereabove.

Preferably, three drive assemblies are provided, which are evenly spaced 120° apart from each other in the circumferential direction.

In the steerable drilling device 100 as described above, the central shaft 170 and the joint drive mechanism 150 do not bear the axial pressure used to drive the drill bit to deflect, so that corresponding bending and damages would not occur. In particular, force transmission between the drill bit joint 160 and the joint drive mechanism 150 occurs mainly in the radial direction only, with essentially zero in the axial direction.

With the above arrangement of the drill bit joint 160 and the joint drive mechanism 150, it is possible for the drive shaft of the drill bit 200 to deflect by an angle so that the drill bit is able to generate a side cutting force. Controlling the drill bit to swing in this way presents higher precision and accuracy. With the rotatable fit of the structures, including the central shaft 170 and the power generating mechanism 130 and the joint driving mechanism 150 connected therewith, with respect to the outer tube 110, it ensures that on the one hand, the outer tube 110 can be rotated during the drilling operation to reduce the backing pressure, and on the other hand, the central shaft 170 and the structures mounted thereon can be substantially non-rotating.

It should be understood that non-rotatable or substantially non-rotatable central shaft 170 is mainly used to prevent the attitude sensor 143 arranged therein from affecting the accuracy of the detection results due to rotation. On this basis, in order to maintain an effective, sealed electrical connection of the attitude sensor 143 with other structures, the components that should be electrically connected to the attitude sensor 143, such as the power generation mechanism 130, the circuit system 142 or the like in the present invention, are also provided on the central shaft 170, such that they do not rotate with respect to each other. Also, in order to ensure that the motor 152 of the drive assembly can be effectively electrically connected to the circuit system 142 and the power generation mechanism 130, the drive housing 151 of the drive assembly is fixedly connected to the central shaft 170 and the connection body 141 of the lower connection mechanism 140 (e.g., through the above-mentioned connecting bars), and a passage through which a wire can pass is formed between the drive housing 151, the connection body 141 and the central shaft 170. The electric connection to the motor 152, the circuit system 142 and the power generation mechanism 130 is achieved through the wire. Moreover, the electrical connection between the attitude sensor 143 and the circuit system 142 can also be achieved through a wire. In order to achieve this fixed connection of the drive housing 151, in the present invention the drive housing 151 of the drive assembly is disposed independently relative to the outer tube 110, and as described above, is arranged within the fluid channel 112 between the outer tube 110 and the drill bit joint 160 for the passage of fluid (e.g., drilling fluid) in the well.

In the context, directional terms "up", "down" or the like are described with reference to the state when the steerable drilling device is in the well, wherein the term "up" refers to a side facing the ground while the term "down" refers to a side facing the bottom of the well.

Finally, it should be noted that the foregoing is only directed to preferred embodiments of the present invention, which does not constitute any limitations to the present invention. Although the present invention is described in detail with reference to the above embodiments, it is still possible for one skilled in the art to modify the technical solutions defined in the above embodiments or to replace some of the technical features with equivalent ones. Any modifications, equivalent substitutions, improvements or the like made within the spirit and principle of the present invention shall fall within the scope of protection of the present invention.

The invention claimed is:

1. A steerable drilling device, comprising:

an outer tube extending along a longitudinal axis;

a drill bit joint inserted into said outer tube, a lower end of said drill bit joint extending out of a lower end of said outer tube for connection to a drill bit, said drill bit joint being configured to rotate with said outer tube;

a joint drive mechanism, provided in said outer tube and configured to drive said drill bit joint to swing relative to the longitudinal axis; and a lower connection mechanism, which comprises:

a connection body, which is connected to said joint drive mechanism in such a manner that said joint drive mechanism is non-rotatable with respect to said connection body;

a first centralizer, arranged between said connection body and said outer tube, and rotatably connected to said connection body;

a circuit system, arranged in said connection body and configured to provide an electrical signal to said joint drive mechanism for driving said drill bit joint to swing; and an attitude sensor, arranged in said connection body and configured to measure deflection and orientation of a well and transmit measurement data to said circuit system, wherein said circuit system is configured to provide the electrical signal to said joint drive mechanism through a wire extending in said connection body and said joint drive mechanism, said joint drive mechanism comprises at least three drive assemblies, which are arranged circumferentially spaced apart from each other around an upper end of said drill bit joint, and wherein each drive assembly of the at least three drive assemblies comprises a push rod extending in a radial direction, said push rod being configured to move in the radial direction to engage with the upper end of said drill bit joint, so as to push said drill bit joint to swing when the push rod moves in the radial direction.

2. The steerable drilling device according to claim 1, wherein the upper end of said drill bit joint is formed with a second spherical engagement protrusion, and an inner end of said push rod is formed with a second spherical engagement groove, which is configured to receive said second spherical engagement protrusion.

3. The steerable drilling device according to claim 1, wherein each drive assembly of the at least three drive assemblies further comprises:

a motor electrically connected to said circuit system via the wire for receiving the electrical signal from said circuit system;

a reducer, provided downstream of said motor and coupled thereto;

an output shaft, extending from a lower end of said reducer in parallel to the longitudinal axis;

a driving gear having an axis parallel to the longitudinal axis, said driving gear being configured as a bevel gear and fixedly connected to a lower end of said output shaft, and being rotatable under drive of said motor; and a driven gear having an axis extending in the radial direction, said driven gear being configured as a bevel gear in engagement with said driving gear and driven in rotation by the driving gear, wherein said driven gear is provided with a central hole extending along its axis and having a first threaded portion formed therein, wherein a second threaded portion is formed on an outer end of said push rod, which is configured to be inserted into the central hole so that said first threaded portion and said second threaded portion come into engagement with each other, and wherein said driven gear is rotatable relative to said push rod, so as to move said push rod in the radial direction through said first threaded portion and said second threaded portion in engagement with each other.

4. The steerable drilling device according to claim 3, wherein each drive assembly of the at least three drive assemblies further comprises a drive housing accommodating the motor, the reducer, the output shaft and the driving gear, wherein said drive housing is fixedly connected to said connection body, and said wire extends within said connection body and said drive housing.

5. The steerable drilling device according to claim 4, wherein the driven gear and the push rod extend at least partially out of said drive housing from an opening in said drive housing, wherein each drive assembly of the at least three drive assemblies further comprises a retractable sleeve, which is arranged around said driven gear and said push rod extending at least partially out of said drive housing from the opening of said drive housing, one end of said retractable sleeve being sealingly connected to the opening of said drive housing and the other end thereof being sealingly connected to the inner end of said push rod, and wherein at least a portion of said retractable sleeve and said drive housing are filled with hydraulic oil.

6. The steerable drilling device according to claim 5, wherein said retractable sleeve is a bellows.

7. The steerable drilling device according to claim 1, wherein said steerable drilling device further comprises a central shaft disposed centrally in said outer tube along the longitudinal axis, said central shaft being rotatably supported on said outer tube through an upper connection mechanism and said lower connection mechanism, and fixedly connected to the connection body of said lower connection mechanism, wherein a power generation mechanism is mounted on said central shaft, and said power generation mechanism comprises:

a generator assembly connected to said circuit system to supply power to said circuit system;

an upper turbine, arranged above said generator assembly and configured to rotate freely in a first direction of rotation relative to said central shaft;

a lower turbine, arranged below said generator assembly and configured to rotate freely in a second direction of rotation relative to said central shaft; and an electromagnetic stabilization assembly arranged below said lower turbine, wherein said first direction of rotation and said second direction of rotation are opposite to each other and both perpendicular to the longitudinal axis.

8. The steerable drilling device according to claim 7, wherein said upper connection mechanism comprises:

a first cylinder, arranged in said outer tube and attached thereto through a second centralizer arranged between the first cylinder and the outer tube; and a second cylinder, arranged in said first cylinder and rotatably fit with said first cylinder with a bearing assembly, said second cylinder being connected to said central shaft.

9. The steerable drilling device according to claim 8, wherein an upper sensing element is provided within said first cylinder, above said second cylinder and spaced apart therefrom, and a lower sensing element is provided within said second cylinder, and wherein said upper and lower sensing elements are configured to transmit a signal from ground to the circuit system of the lower connection mechanism, or to transmit a signal from the circuit system to the ground.

* * * * *